US008872010B2

(12) United States Patent
Villaran-Valdivia

(10) Patent No.: US 8,872,010 B2
(45) Date of Patent: Oct. 28, 2014

(54) AUTOMATIC GUITAR TUNER

(71) Applicant: Luis Villaran-Valdivia, Stanford, CA (US)

(72) Inventor: Luis Villaran-Valdivia, Stanford, CA (US)

( * ) Notice: Subject to any disclaimer, the term of this patent is extended or adjusted under 35 U.S.C. 154(b) by 0 days.

(21) Appl. No.: 13/954,646

(22) Filed: Jul. 30, 2013

(65) Prior Publication Data

US 2014/0033893 A1 Feb. 6, 2014

Related U.S. Application Data

(60) Provisional application No. 61/677,475, filed on Jul. 31, 2012.

(51) Int. Cl.
*G10G 7/02* (2006.01)
*G10D 3/14* (2006.01)

(52) U.S. Cl.
CPC ... *G10D 3/14* (2013.01); *G10G 7/02* (2013.01)
USPC ..... 84/455

(58) Field of Classification Search
CPC ..... G10D 3/14; G10D 3/00; G10D 3/10; G10D 3/006; G10D 3/143; G10D 9/005; G10D 3/186
USPC ..... 84/454, 455, 458
See application file for complete search history.

(56) References Cited

U.S. PATENT DOCUMENTS

| | | | | |
|---|---|---|---|---|
| 6,278,047 | B1 | 8/2001 | Cumberland | |
| 7,692,085 | B2 * | 4/2010 | Adams | 84/454 |
| 7,935,876 | B1 * | 5/2011 | West | 84/304 |
| 2006/0037459 | A1 | 2/2006 | Skinn | |
| 2007/0214935 | A1 | 9/2007 | Lyles | |
| 2007/0240554 | A1 | 10/2007 | Hany | |
| 2008/0006140 | A1 | 1/2008 | Adams | |

* cited by examiner

*Primary Examiner* — Jeffrey Donels
(74) *Attorney, Agent, or Firm* — Craig M. Stainbrook; Stainbrook & Stainbrook, LLP

(57) ABSTRACT

An automatic tuning device including a plurality of universal attachment clamp and tuning motor assemblies, a head-mounted electronics enclosure, and a power pedal. A stringed instrument analog signal is processed by electronics in the power pedal, which calculates and then wirelessly sends information about what string is being played and whether it is in tune. The information is received by a head-mounted electronics enclosure, which then actuates a motor to turn a corresponding tuning peg as needed. The tuning motors are disposed on a universal attachment clamp, which is designed to remain on the instrument headstock securely and unobtrusively.

20 Claims, 9 Drawing Sheets

AUTOMATIC GUITAR TUNER

CROSS REFERENCES TO RELATED APPLICATIONS

The present application claims the benefit of U.S. Provisional Patent Application Ser. No. 61/677,475, filed Jul. 31, 2013.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

1. Field of the Invention

The present invention relates generally to accessories for musical instruments, and more particularly to musical instrument tuning devices, and still more particularly to automatic musical instrument tuning devices.

2. Background Discussion

The following patents describing automatic tuning devices use electromechanical devices to change or maintain pitch.

US Patent Application Pub. No. 20080006140, by Adams, discloses an automatic tuning device for a guitar which includes a recording device for recording a tone generated by striking a string and for the output of a digital signal corresponding to the recorded tone, a memory device for storage of given digital signals which correspond to a desired tone, a comparator device for comparison of the digital signal output by the recording device with a digital signal corresponding to the desired tone stored in the memory device, an adjuster device for altering the tension of the strings, at least one actuator, for operating the adjuster device, a controller connected to the comparator device, which controls the at least one actuator using a bus line, by means of a difference determined in the comparator device between the signals representing the generated tone and the desired tone.

US Patent Application Pub. No. 20070240554, by Hany, teaches an attachable string tension control device for adjusting the pitch of each string of a musical instrument. The invention purportedly allows a user to switch instantly between a variety of pre-selected tunings and includes a housing with a plurality of string tension and string height adjustment elements, an attaching system to attach the tuning system to a musical instrument, and a clamping system, and a shaft having a handle for connecting the manual force applied to it to the string tension elements.

US Patent Application Pub. No. 20070214935, by Lyles, teaches a stringed musical instrument tuning device using springs to apply tension to corresponding musical strings. Each spring is chosen and configured to impart a string tension generally matched to the appropriate tension of the string at perfect tune. The spring is selected and arranged so that the tension in the string maintains at or near perfect tune even as the string elongates or contracts over time. In one embodiment, once a string is placed in appropriate tune, a mechanical visual indicator is set. As such, if the string tune changes due to elongation or contraction, the change is reflected by misalignment of the mechanical visual indicator even if the change cannot be aurally detected. Lyles claims to reestablish and maintain perfect tune by realigning the indicator or interposing a force modulating member between a spring and its corresponding musical string such that the tension applied to the string by the spring is not linearly related to the force exerted by the spring as the spring changes in length.

US Patent Application Pub. No. 20060037459, by Skinn, describes an apparatus and a method for self-tuning stringed musical instruments with an accompanying vibrato mechanism. The tuning system includes a detector for detecting a first musical tone produced by a string and for producing a signal value corresponding to that tone; a processor coupled to the detector to compare the signal to a reference frequency value associated with a desired frequency and to produce an electrical control signal, which is a function of the difference between the signal value and the reference frequency value; and a string adjustment assembly coupled to the processor and to the string for adjusting the tension of the string in accordance with the electrical control signal. The string adjustment assembly comprises a motor and gear assembly pivotally attached to a housing.

The above-described systems and devices mentioned all require considerable permanent alterations of the musical instrument in or on which they are installed (viz., guitars). The effect is that the tuning systems cannot be easily moved from one guitar to another, and permanent alterations to the guitar can be expected to adversely affect the sound of the instrument.

U.S. Pat. No. 6,278,047 describes an apparatus for tuning stringed instruments in which each string of the instrument is connected to a corresponding sensor and a tensioning driver. The sensor provides to a microprocessor controller a real time value of the tension in the string. A computer receives the real time tension value from the microprocessor and compares it to a predetermined reference value. Feedback information is provided to the microprocessor, which commands the driver to adjust the string tension accordingly. The tuner does not remain coupled to the instrument. Rather, it is attached, operated, and detached when the tuning operation is completed. This gives it the advantage of being adaptable for use with a number of different kinds of stringed instruments, but it also lacks mobility and ease of use. Every time a user wants to tune an instrument, he or she must unplug everything and connect the instrument to the tension sensing device. After tuning, he or she can then continue using the instrument.

The foregoing patents and patent applications reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention is an automatic tuning device made up of three principal subcomponents: (1) a universal attachment clamp and tuning motor assembly ("clamp and motor mount"); (2) a headstock-mounted electronics enclosure; and (3) a power pedal. A plurality of the clamp and motor mount assemblies are combined with the headstock-mounted electronics enclosure and the power pedal to comprise a tuning system for stringed instruments having a plurality of strings and a headstock with tuning pegs. The device can be easily attached to and detached from any electric bass guitar, though the apparatus may be adapted for use with all stringed instruments. It is designed to remain installed on an electric bass during practice and performances without at all interfering with, or adversely affecting, the playability of the instrument. When the device is on, the user only needs to play a string and the device determines which string is being played and whether it is in tune or not. If the string is not in tune, the device turns the corresponding tuning peg as necessary to correct the error. When the device is off, the electric bass functions normally.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways. As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention. Thus, the fundamental aspects of the invention, along with the various features and structures that characterize the invention, are pointed out with particularity in the claims annexed to and forming a part of this disclosure. For a better understanding of the present invention, its advantages and the specific objects attained by its uses, reference should be made to the accompanying drawings and descriptive matter in which there is illustrated the preferred embodiment.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
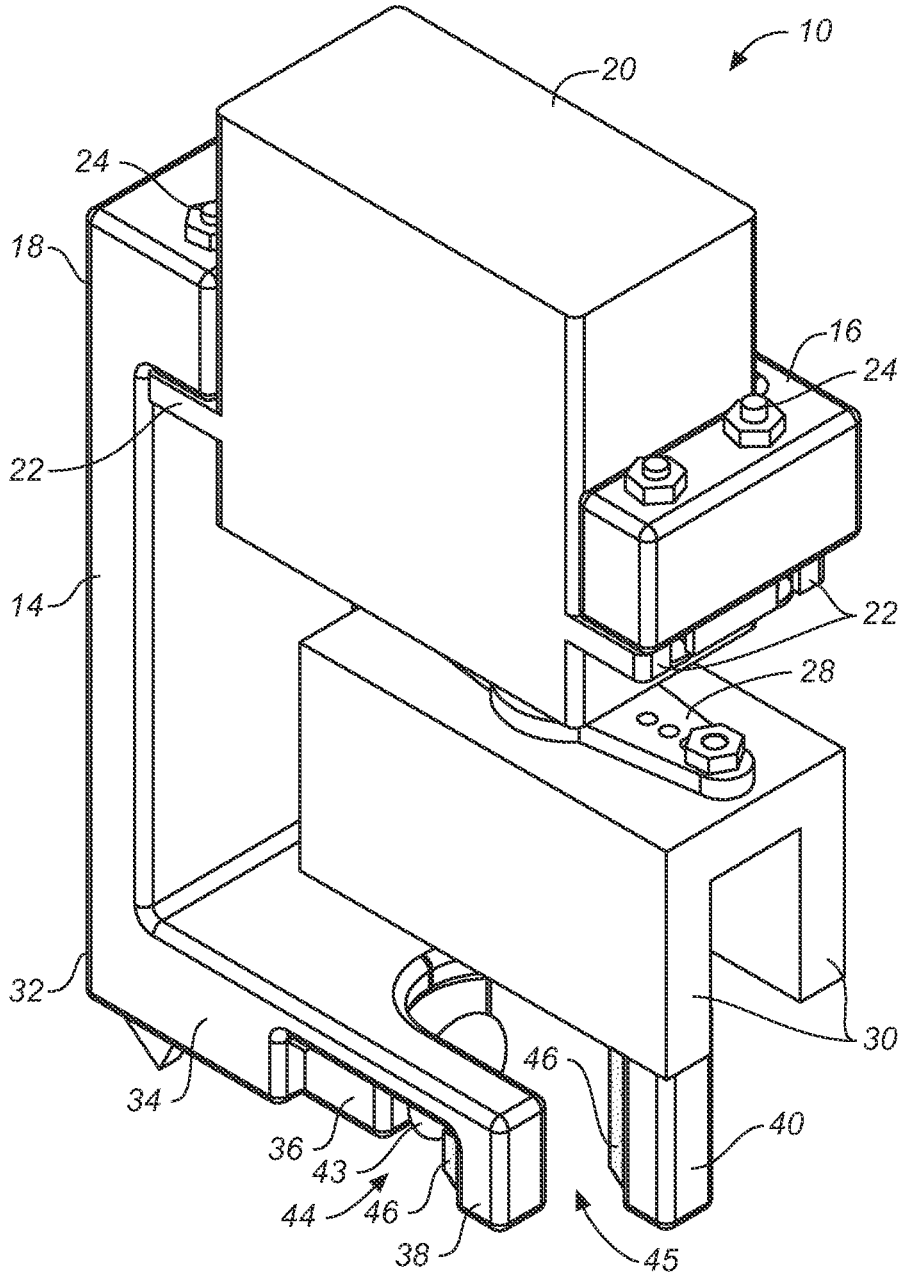
FIG. 1 is an upper left front perspective view of the inventive universal attachment clamp and tuning motor assembly of the present invention.
Figure 2A:
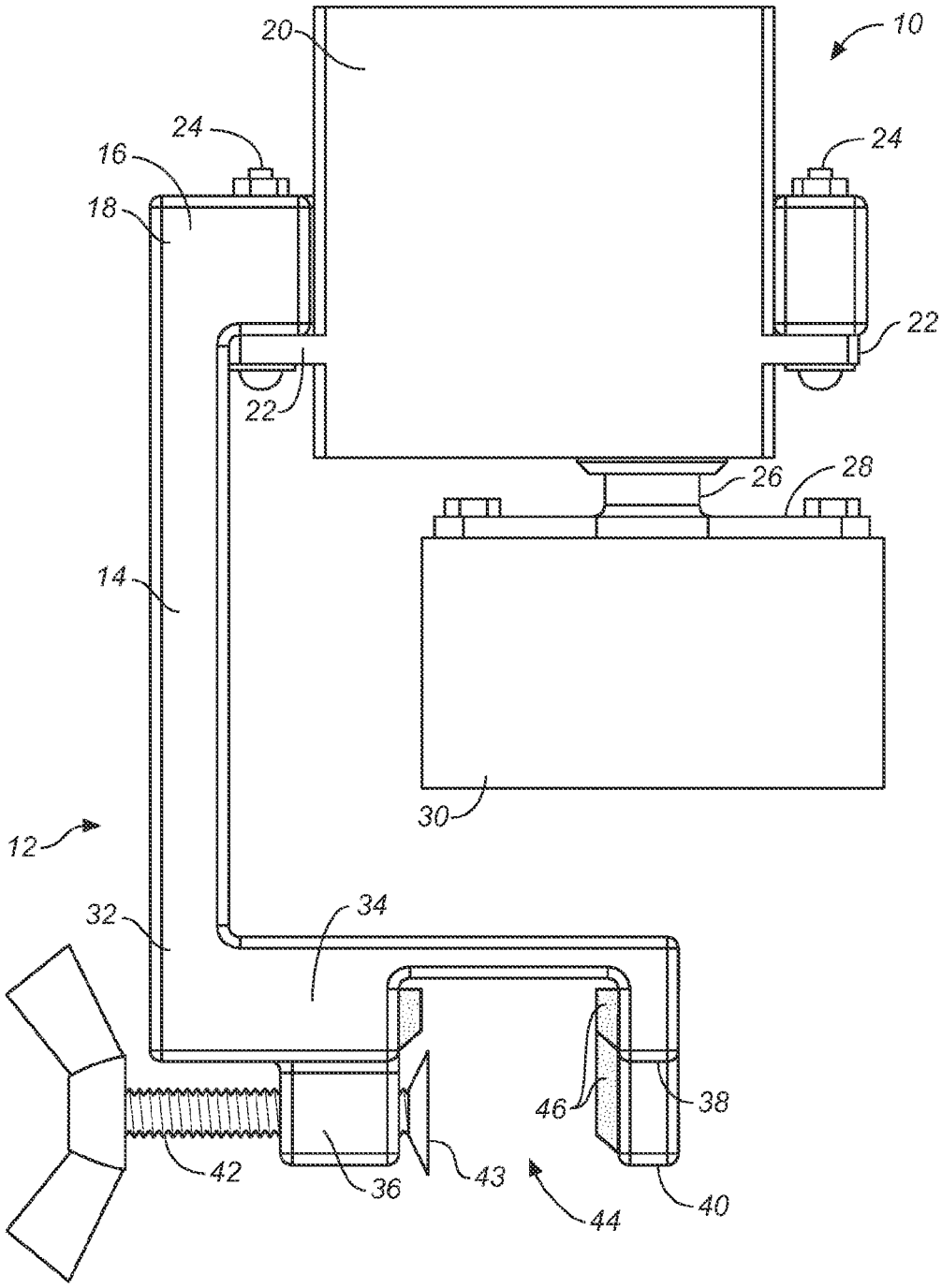
FIG. 2A is a left side view in elevation thereof.
Figure 2B:
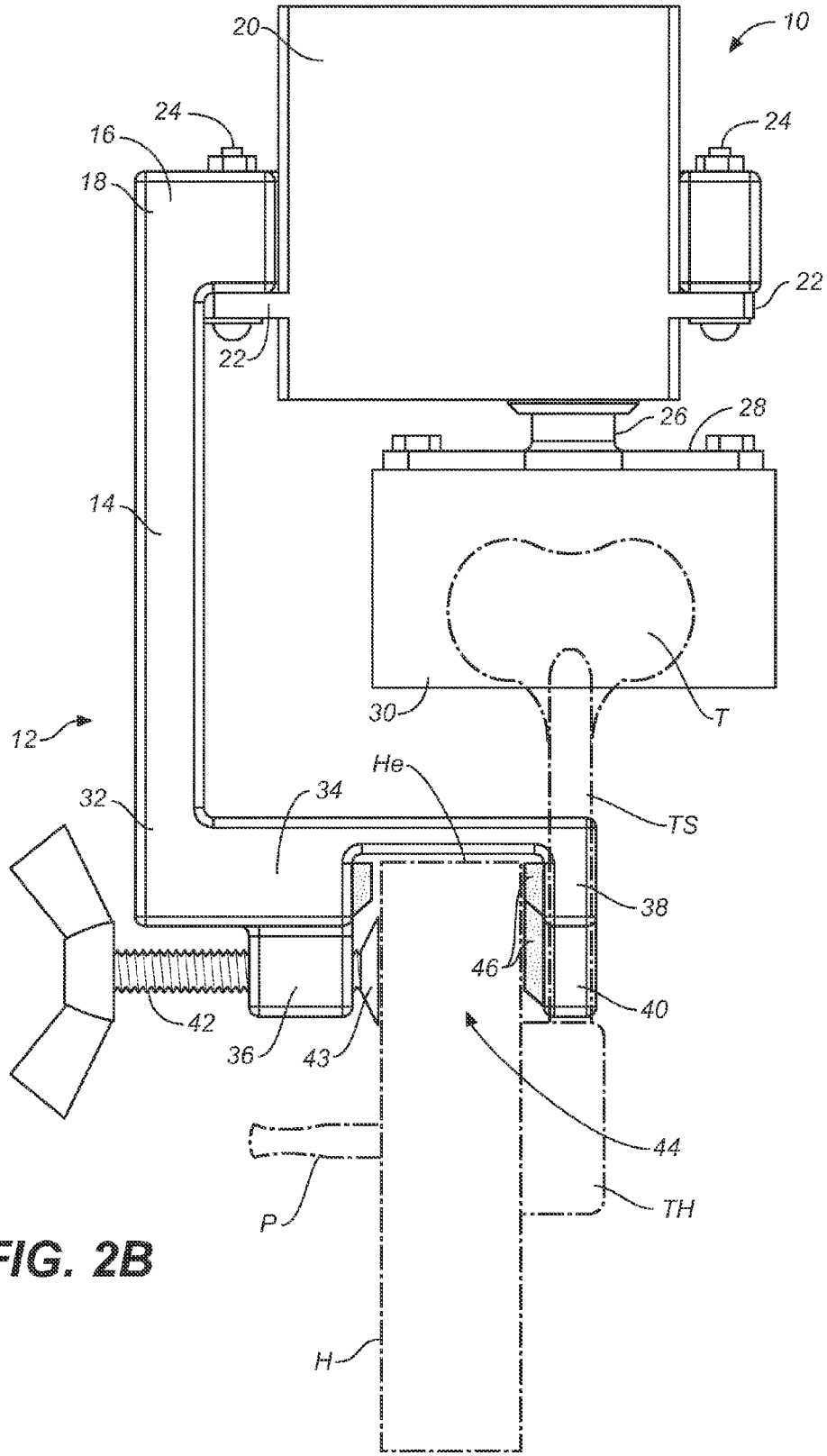
FIG. 2B is a left side view in elevation showing a clamp and motor mount assembly installed on a guitar headstock and operatively disposed over a tuning peg, the guitar structures shown in phantom.

Referring to FIGS. 1 through 7, wherein like reference numerals refer to like components in the various views, there is illustrated therein a new and improved automatic guitar tuner. The first major component is the universal attachment clamp and tuning motor assembly, generally denominated 10 herein. Referring first to FIGS. 1-2B, it will be seen that the universal attachment clamp and tuning motor assembly 10 (referred to herein as the "clamp and motor mount assembly") includes a frame 12 having a vertical support 14, a motor mount arm 16 preferably integral with and extending forwardly from the upper end 18 of the vertical support 14. The motor mount arm 16 may be configured to accommodate the housing of a tuning motor 20, or it may simply be provided with through holes that can be aligned with holes in mounting flanges 22 disposed on the tuning motor housing so that mounting bolts 24 can be passed.

Operatively attached to the tuning motor drive shaft 26 via a drive shaft coupling plate 28 is a tuning peg channel bar 30 (or tuning peg connector), which engages the tuning pegs extending from a guitar headstock.

Disposed on and extending forwardly from the lower end 32 of the vertical support 14 is a headstock mounting arm 34 which includes a downwardly depending rear clamping boss 36 and two downwardly depending fingers, including a short front finger 38, and a long front finger 40. The rear clamping boss 36 has a threaded through hole in which a tightening screw 42 can be passed. The rear clamping boss 36 and the short and long front fingers 38, 40, are spaced apart so as to define a channel 44 into which the edge of a headstock can be inserted and clamped. The interior surfaces of these elements include rubber bumpers 46 to prevent damage to the headstock. The space between the short and long fingers 38, 40 also forms a channel 45 into which a tuning peg stem TS can be vertically disposed, such that positioning the clamp and motor assembly on the guitar headstock H enables the tuning key post to extend between short and long fingers 38, 40 such that the tuning key knob T is straddled by the tuning peg channel bar 30. In this configuration, the long finger 40 of the universal attachment clamp extends substantially down to the tuning peg gear housing TH, which is, of course, operatively connected to the tuning peg post P around which the corresponding string is wrapped.

The universal attachment clamp 12 may be fabricated from high-strength plastic or any other sufficiently rigid, strong, and lightweight material, such as a lightweight metal. The tuning peg channel 30 is preferably made from any high-strength plastic. The rubber bumpers 46 may be made of any pliable rubber or rubber-like material.

Figure 3:
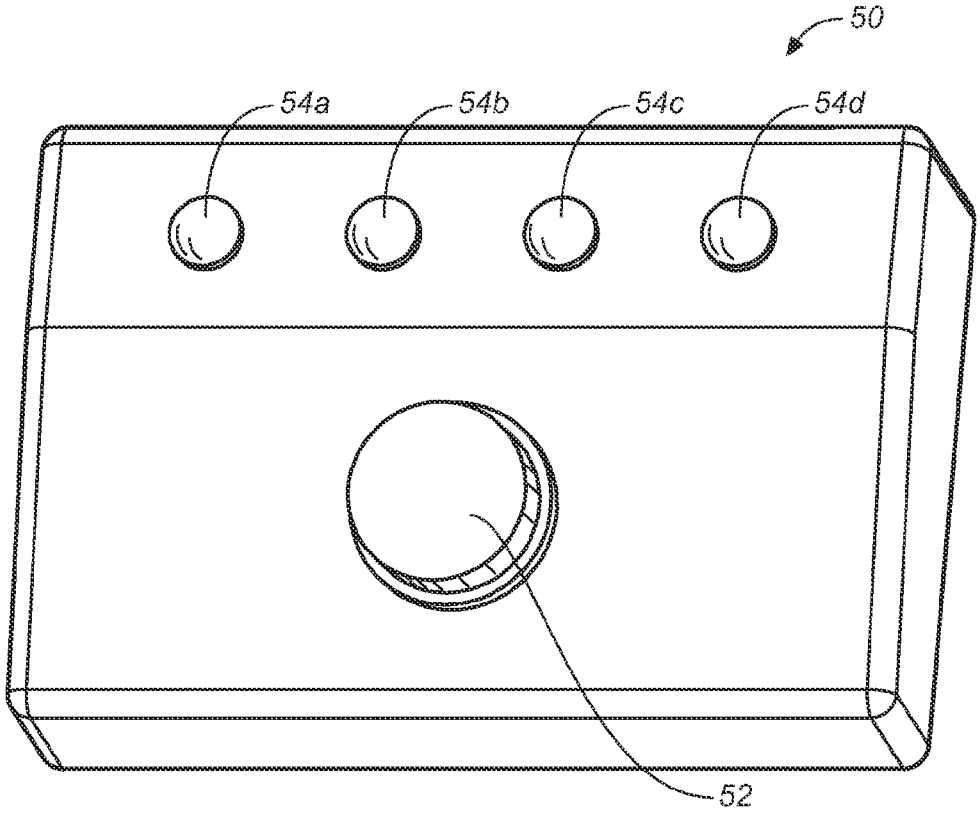
FIG. 3 is an upper front perspective view of a headstock-mounted electronics enclosure as used in the automatic tuning system of the present invention, here shown without wires for connection to tuning motors.

Referring next to FIG. 3, there is shown headstock-mounted electronics enclosure 50 having a button 52 for user input, and four LEDs, 54*a*, 54*b*, 54*c*, and 54*d*, to provide visual indications to the user. Inside the low profile and generally rectangular enclosure is an electronics board with a microcontroller and wireless transceiver. The wireless transceiver receives frequency information via wireless signals from a power pedal 70, discussed in detail in connection with FIG. 5. The microcontroller compares the frequency received from the power pedal with the four frequencies of correctly tuned bass guitar strings and determines which it is closest to. It will assume a match between a string having a correct frequency closest to the actual frequency of the string being played. The microcontroller then calculates an error based on how far the frequency received is from the desired frequency and from this, the device can determine whether the string is sharp, flat, or acceptably in tune.

Figure 4A:
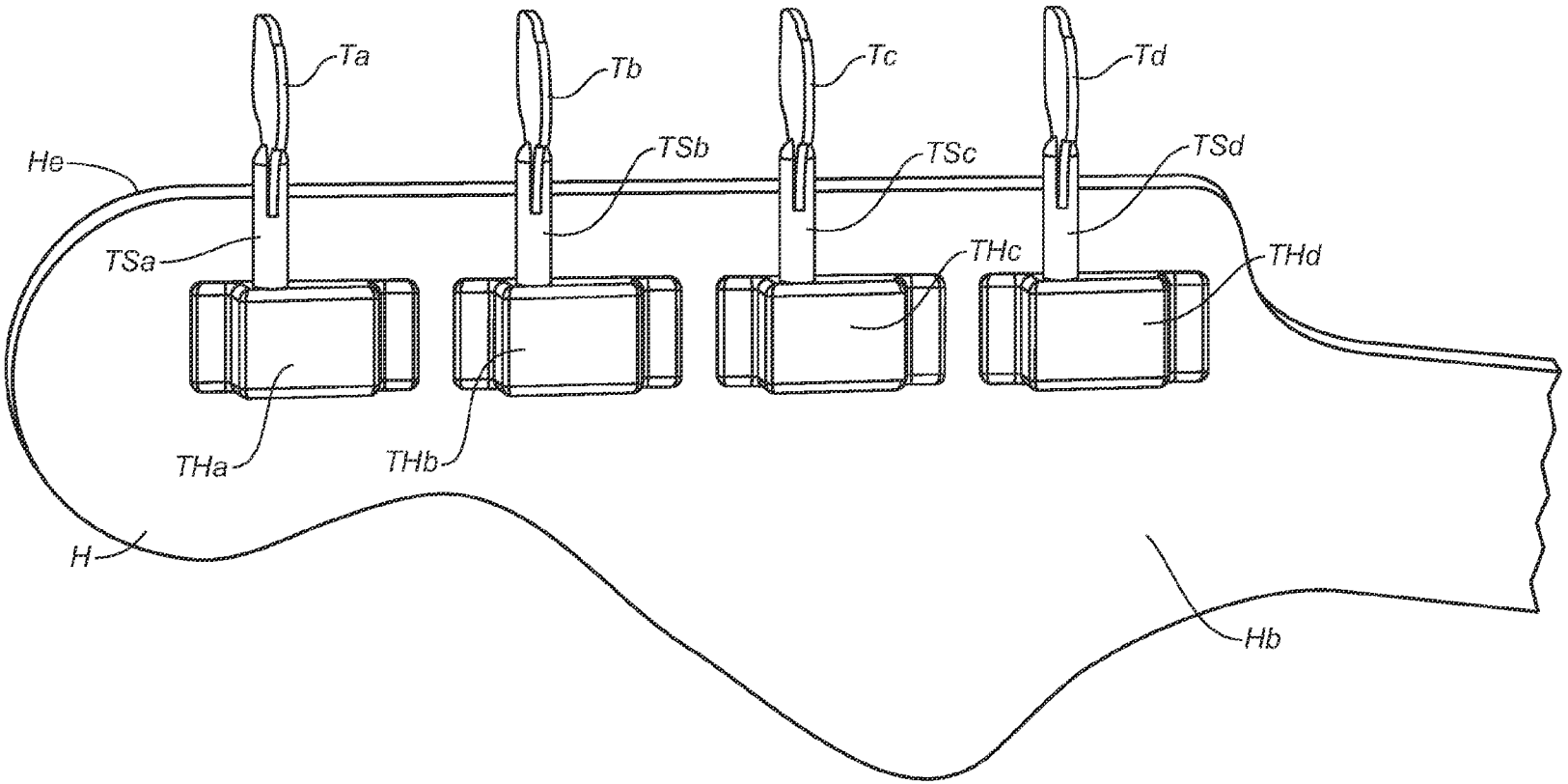
FIG. 4A is a rear view in elevation of a bass guitar headstock showing the structural features of the back of the headstock and the tuning pegs with which the inventive system is engaged when installed.
Figure 4B:
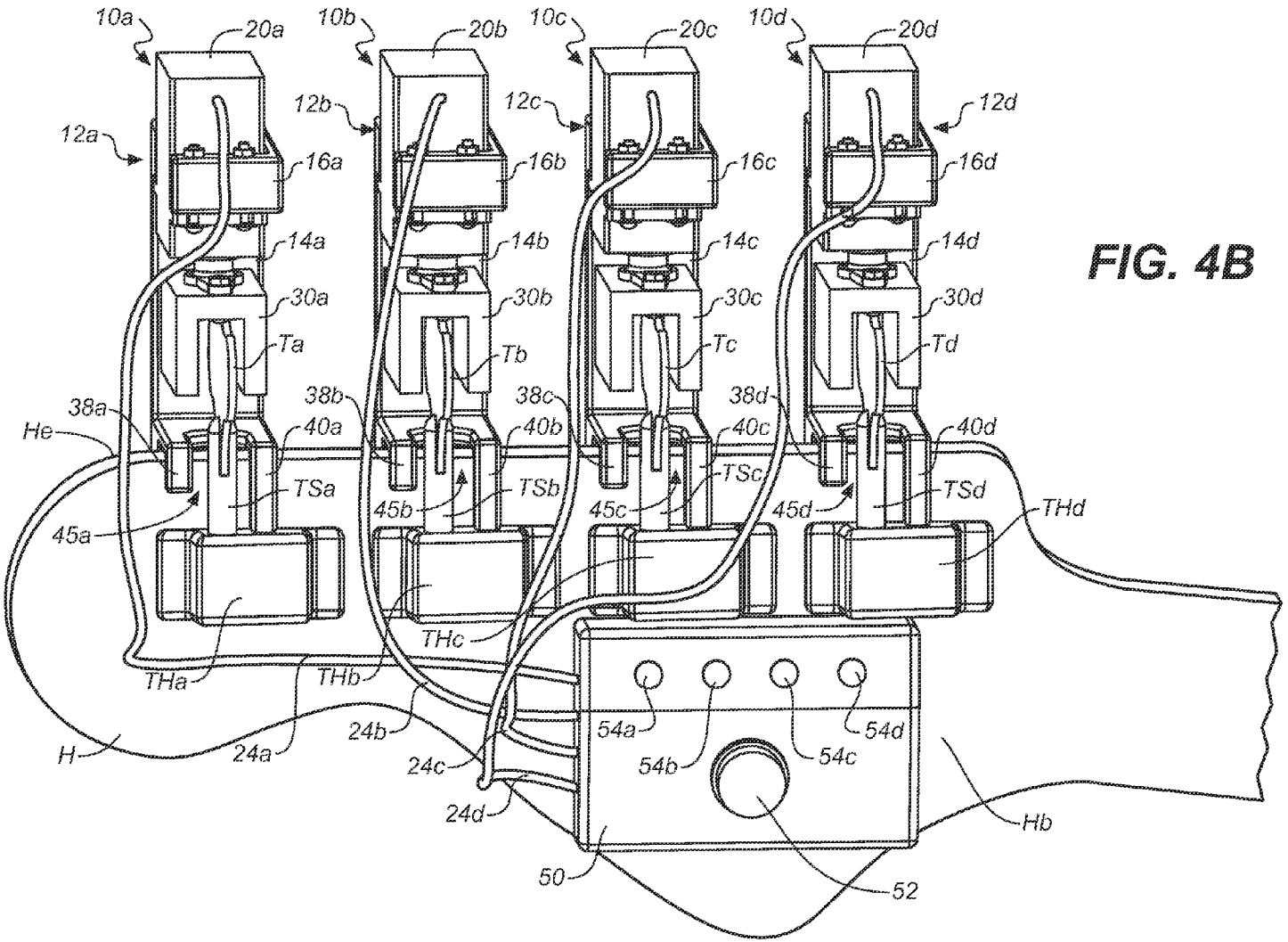
FIG. 4B is an upper front perspective view showing a plurality of the clamp and tuning motor assemblies of FIG. 1 and the headstock-mounted electronics enclosure of FIG. 3 mounted on the backside of a bass guitar headstock.

Referring now to FIGS. 4A and 4B, it will be seen that in an implementation for use on an electric bass guitar, four clamp and tuning motor assemblies s 10*a*, 10*b*, 10*c*, and 10*d*, are mounted on the upper edge He of the guitar headstock H. such that the four tuning peg stems TSa, TSb, TSc, and TSd are disposed through channels 45*a*, 45*b*, 45*c*, and 45*d*, and the tuning key knobs Ta, Tb, Tc, and Td are straddled by the respective tuning peg channel bars, 30*a*, 30*b*, 30*c*, and 30*d*. Theheadstock-mounted electronics enclosure 50 is mounted on the back side Hb of the headstock H and is electrically connected to the four tuning motors 20*a*, 20*b*, 20*c*, 20*d* via individual wires, 24*a*, 24*b*, 24*c*, 24*d*. The microcontroller in the electronics enclosure sends control signals to the tuning motors to turn the tuning pegs specified amounts according to the calculated errors.

While in a preferred embodiment the electronic connected between the electronics in electronic enclosure 50 is accomplished through physical wires, it will be appreciated that wireless signaling using a number of suitable small area wireless communications technologies is also possible and is contemplated in the instant disclosure, including Bluetooth, wireless induction, infrared wireless, ZigBee, and the like.

Referring to FIG.4B, it will also be seen that a headstock-mounted electronics enclosure 50 is mounted on the backside of the headstock H , preferably below one or more of the tuning peg gear housings THa, THb, THc, THd. The clamp and motor assemblies are positioned such that each tuning peg Ta, Tb, Tc, and Td, of the instrument fits into and is disposed upwardly through the tuning peg channel 45*a*, 45*b*, 45*c*, 45*d*, of one of the four universal attachment clamps, and thus each tuning peg stem is straddled by the short and long fingers 38*a*-38*d*, and 40*a*-40*d*, respectively. In this configuration, each tuning peg gear housing THa, THb, THc, THd, is generally disposed under the long front finger 40*a*- 40*d*, respectively. Importantly, each tuning peg is operatively disposed within the corresponding tuning peg channel bar 30*a*, 30*b*, 30*c*, and 30*d*. The headstock-mounted electronics enclosure 50 may be attached to the headstock in a number of suitable ways, though attachment using hook and loop fastener material is simple and sufficient. It will be appreciated that mounting brackets, fasteners, and several alternative attachment means may be employed.

The control electronics in the headstock-mounted electronics enclosure are turned on with a long-press to the power button 52. Under normal operation the automatic tuning device will determine which string is being played. However, if the electric bass guitar is unusually out of tune, the microcontroller may have difficulty determining which string is being played. Therefore, the user may use the power button 52 to override the device and select a particular string to tune. The corresponding LED 54*a*-54*d* will turn on indicating which string is currently being tuned. The headstock-mounted electronics can be turned off by a sustained press to the button 52.

The headstock-mounted electronics enclosure 50 may be fabricated from lightweight plastic or any other sufficiently lightweight material such as a lightweight metal.

Figure 5:
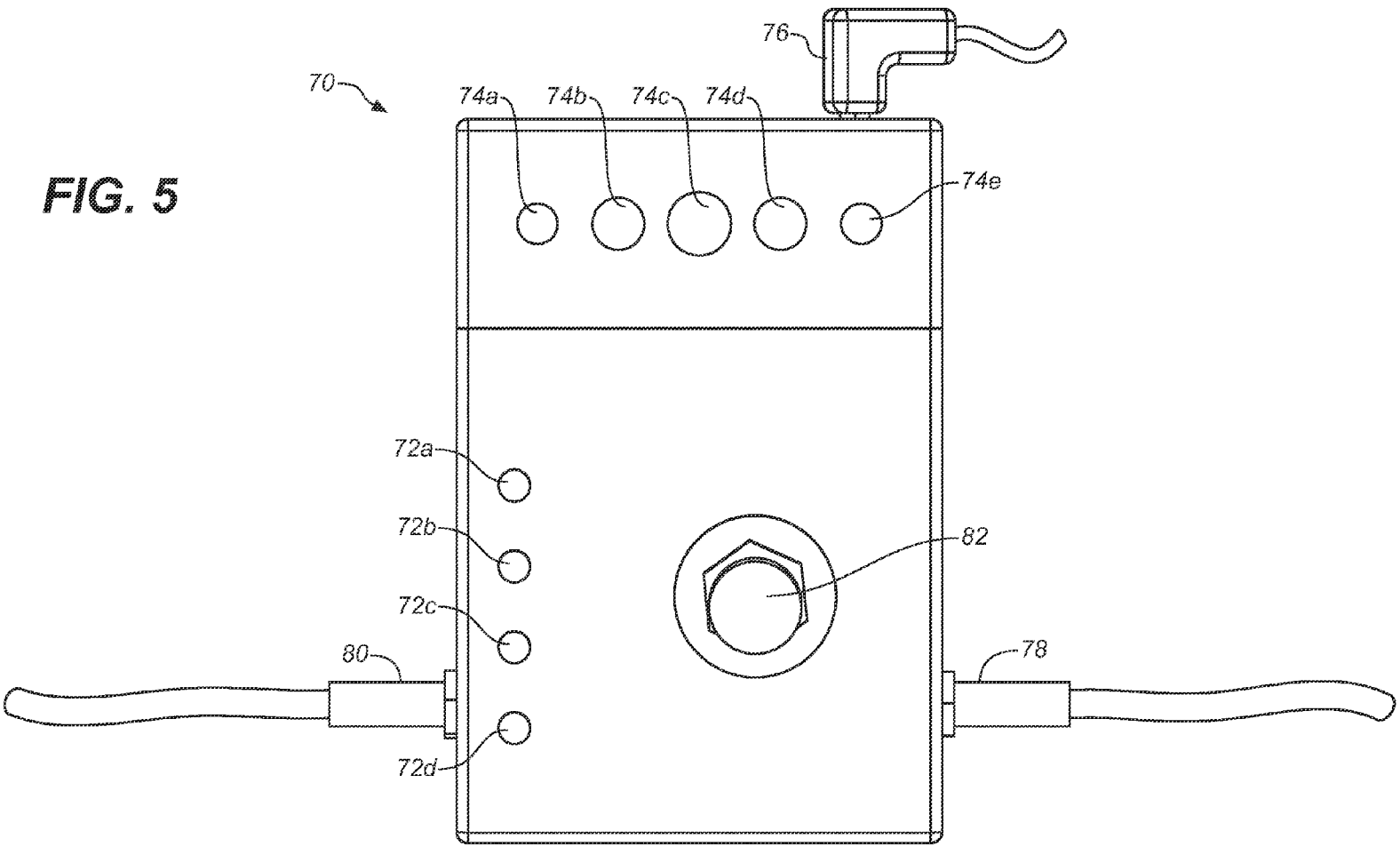
FIG. 5 is a top plan view of a power pedal of an automatic tuning device of the present invention.
Figure 6:
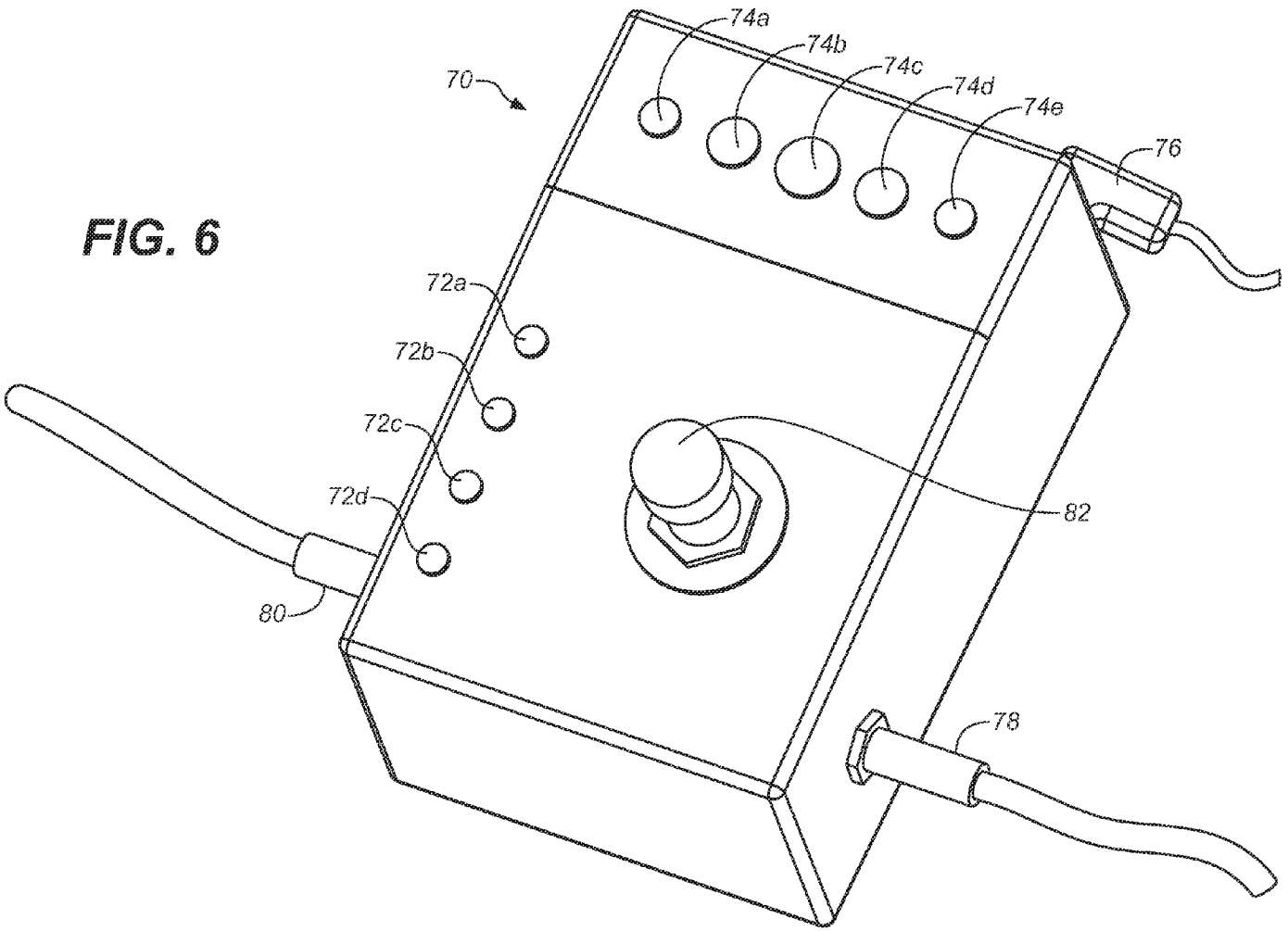
FIG. 6 is an upper front perspective view of a power pedal of FIG. 5.

Referring now to FIG. 5 and FIG. 6, there are shown a power pedal 70 having four string-indicating LEDs 72*a*, 72*b*, 72*c*, 72*d*, five tune-indicating LEDs 74*a*, 74*b*, 74*c*, 74*d*, 74*e*, and various input and output jacks, including a power input jack 76 into which a user plugs a transformer to provide power to the device, a guitar input jack 78 into which the user connects the electric bass guitar cord. On an opposing side of the power pedal is an output jack 80 from which the user can connect a cord to an amp, preamp, pedal, and so forth. When the automatic tuning device is off, the signal from the electric bass guitar bypasses the power pedal and goes directly to any other devices the user may have it connected to (e.g. amp, preamp, other pedals, etc.). When the automatic tuning device is turned on via the stomp switch 82, however, the signal is cut from other devices and is instead used to tune the device. As will be appreciated, the power pedal 70 may be made of metal or any sufficiently rigid and strong material such as a high-strength plastic.

Figure 7:
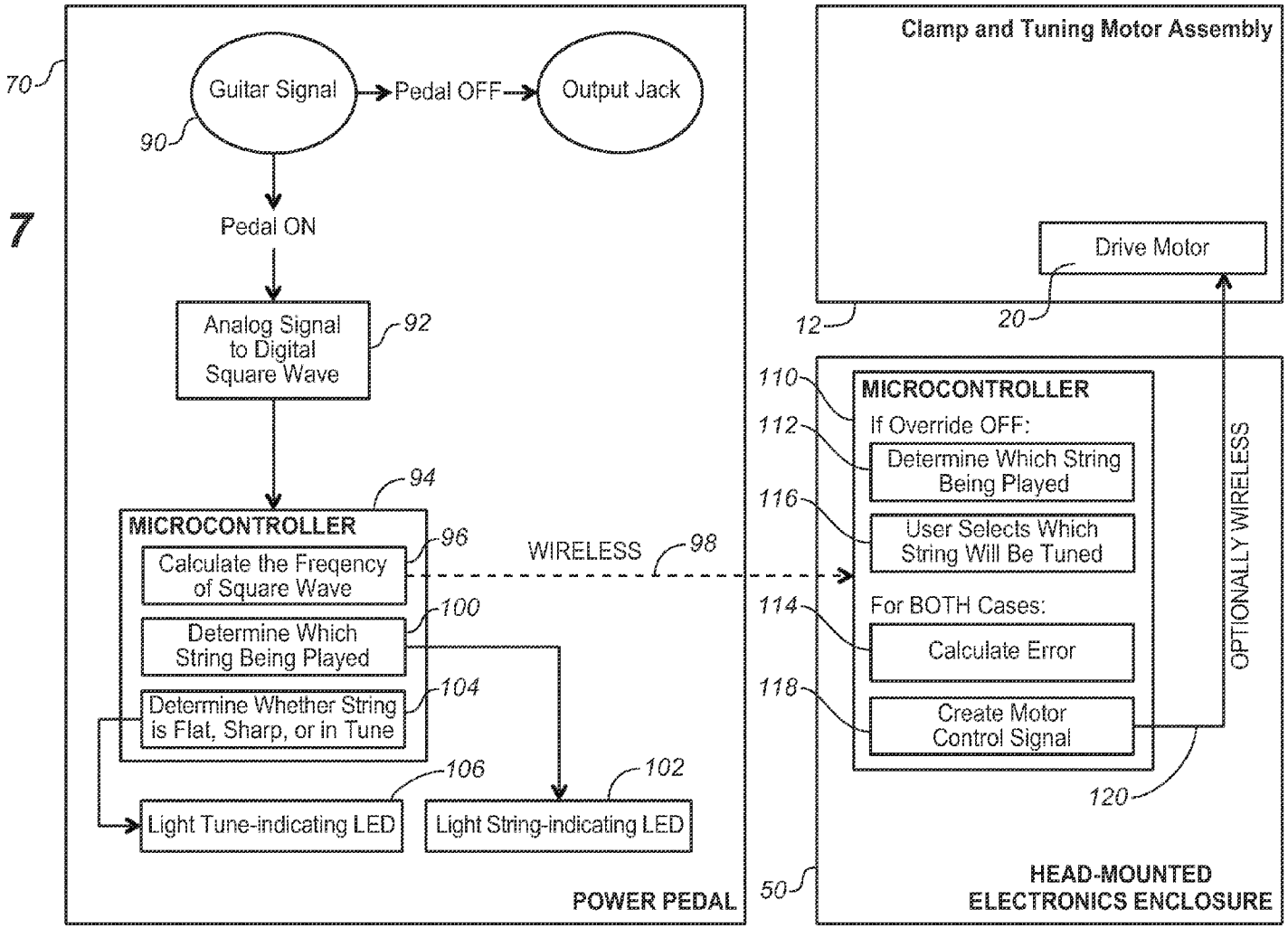
FIG. 7 is a schematic block diagram showing the processing steps accomplished by the microcontrollers employed in the inventive system.

Referring next to FIG. 7, when the inventive tuning device is properly installed on an instrument, as shown in FIG. 4B, and then when a string is activated, the power pedal receives an input electric analog signal 90 from the guitar and converts it 92 into a digital square wave with a frequency equal to the frequency of the string being played. It does this via signal conditioning circuitry in the power pedal. A power pedal microcontroller 94 then calculates the frequency of the square wave 96 and transmits this information in a wireless signal 98 to the headstock-mounted electronics enclosure 50. The power pedal microcontroller then also determines which string is being played 100 (similarly to the headstock-mounted electronics enclosure) and lights 102 one of four string-indicating LEDs 72*a*- 72*d* indicating which string the power pedal microcontroller calculates as being played. Furthermore, the power pedal microcontroller 94 in the power pedal 70 determines whether the strings is sharp, flat, or in tune 104 (similarly to the headstock-mounted electronics enclosure) and lights 106 one of the five tune-indicating LEDs 74*a*- 74*e* indicating whether the string is flat (left LEDs), sharp (right LEDs), or in tune (middle LED). Thus, the user is provided with visually perceivable information indicating when the device is finished tuning a string when the middle LED is finally lit up.

As earlier indicated, the user may use the power button 52 to override 116 the automatic tuner and select a particular string to tune. The corresponding LED 54*a*-54*d* on the head mounted electronics enclosure will turn on indicating which string is currently being tuned. In either case, the head mounted microcontroller 110 calculates the tuning error and sends 118 a motor control signal 120 (optionally wireless) to the appropriate drive motor 20*a*-20*d* disposed on a corresponding clamp and tuning motor assembly 10*a*, 10*b*, 10*c*, and 10*d*, to turn the engaged tuning peg as necessary to bring the string into proper tune.

As previously noted, and referring still to FIG. 7, the headstock-mounted microcontroller 110 in headstock-mounted electronics enclosure 50 compares the frequency received from the power pedal with the four frequencies of correctly tuned bass guitar strings and determines 112 which it is closest to. It will assume a match between the string having a correct frequency closest to is the string being played. The headstock-mounted microcontroller 110 then calculates an error 114 based on how far the frequency received is from the desired frequency and from this, the headstock-mounted microcontroller can determine whether the string is sharp, flat, or acceptably in tune.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

An automatic tuning device including a plurality of universal attachment clamp and tuning motor assemblies, a headstock-mounted electronics enclosure, and a power pedal. A stringed instrument analog signal is processed by electronics in the power pedal, which calculates and then wirelessly sends information about what string is being played and whether it is in tune. The information is received by a headstock-mounted electronics enclosure, which then actuates a motor to turn a corresponding tuning peg as needed. The tuning motors are disposed on a universal attachment clamp, which is designed to remain on the instrument headstock securely and unobtrusively.

What is claimed as invention is:

1. An automatic tuner for a stringed instrument having a headstock and a plurality of tuning pegs disposed thereon, said automatic tuner comprising:

a plurality of clamp and tuning motor assemblies, one for each of the strings on the stringed instrument, each of said clamp and tuning motor assemblies configured for attachment to the stringed instrument headstock and including clamping elements, a motor mount, and a tuning motor having a drive shaft operatively connected to a tuning peg connector;

a power pedal having an instrument input jack for receiving an input electric analog signal from the stringed instrument, an analog to digital converter for converting the input electric analog signal into a digital square wave with a frequency equal to the frequency of the string being played, and a power pedal microcontroller programmed to calculate the frequency of the square wave, and transmit the calculated frequency information in a wireless signal; and a headstock-mounted electronics enclosure mountable on the stringed instrument, said headstock-mounted electronics enclosure housing an electronics board electrically connected to each of said clamp and tuning motor assemblies, and having a wireless transceiver for receiving the wireless signal from said power pedal, and further enclosing a headstock-mounted microcontroller programmed to compare the frequency received from said power pedal with four frequencies of a correctly tuned bass guitar strings, determine which string the received frequency is closest to, and calculate an error based on how far the frequency received from said power pedal is from the correct frequency, such that from said calculated error, said headstock-mounted microcontroller can determine whether the string is sharp, flat, or acceptably in tune, and thereafter send a motor control signal to the appropriate motor on one of said clamp and tuning motor assemblies so as to correct and maintain the correct tune for a string engaged by said tuning peg connector.

2. The automatic tuner of claim 1, wherein said clamp and motor assemblies each include a vertical support, a headstock mounting arm with clamping elements disposed on a lower end of said vertical support, a motor mount arm extending forwardly from an upper end of said vertical support for mounting a tuning motor.

3. The automatic tuner of claim 2, wherein said tuning peg connector is a tuning peg channel bar operatively connected to said tuning motor drive shaft, wherein said tuning peg channel bar straddles and disposed over a tuning peg knob when installed on the headstock.

4. The automatic tuner of claim 2, wherein said tuning motor drive shaft is connected to said tuning peg channel bar through a drive shaft coupling plate.

5. The automatic tuner of claim 2, wherein said clamping elements include a downwardly depending rear clamping boss and first and second fingers spaced apart from said rear clamping boss so as to form a channel for placement of an upper edge of the headstock and spaced apart from one another so as to accommodate the stem of a tuning peg.

6. The automatic tuner of claim 5, wherein said first and second fingers include a short finger and a long finger.

7. The automatic tuner of claim 1, wherein said power pedal includes an output jack for connecting a cord to electronic sound equipment.

8. The automatic tuner of claim 1, wherein said power pedal is confingured for coupling to an amp, a preamp, and a pedal through said output jack.

9. The automatic tuner of claim 1, wherein said headstock-mounted microcontroller assumes a match between a string having a correct frequency closest to the string being played.

10. The automatic tuner of claim 1, wherein said power pedal includes a power on/power off stomp switch.

11. The automatic tuner of claim 10, wherein when the power pedal is turned on via said stomp switch, the input electric analog signal from the stringed instrument is cut from other devices and is instead used to tune the device.

12. The automatic tuner of claim 1, wherein when the power pedal is turned off the input electric analog signal from the stringed instrument bypasses said power pedal and goes directly to any other electronic sound equipment to which a user has connected said power pedal.

13. The automatic tuner of claim 1, wherein installation of said clamp and tuning motor assemblies on a stringed instrument headstock does not require the removal or change in position of any structural feature of the stringed instrument.

14. The automatic tuner of claim 1, wherein when said automatic tuner is turned on, a user need play only a single string, and said power pedal microcontroller and said headstock-mounted microcontroller each determine which string is being played and whether it is in tune or not.

15. The automatic tuner of claim 14, wherein said headstock-mounted electronics enclosure includes a plurality of lights disposed on an exposed surface to provide visual indications to the user of the string being tuned.

16. The automatic tuner of claim 1, wherein said headstock-mounted electronics enclosure includes a plurality of lights disposed on an exposed surface to provide visual indications to the user of the string being tuned.

17. The automatic tuner of claim 1, wherein said power pedal includes a plurality of string indicating lights for indicating to a user which string is being played and a plurality of tune indicating lights indicating to a user whether the string is sharp, flat, or in tune.

18. The automatic tuner of claim 1, including four clamp and tuning motor assemblies, one each for placement over a tuning peg on the headstock of an electric bass guitar.

19. The automatic tuner of claim 1, wherein said headstock-mounted electronics enclosure is provided with attachment structure for attachment to the backside of a headstock.

20. The automatic tuner of claim 1, wherein said headstock-mounted electronics enclosure includes a power button for a user to selectively to override said automatic tuner so as to tune the stringed instrument manually, and wherein during manual tuning, one of said plurality of lights on said headstock-mounted electronics enclosure indicates which string is currently being tuned.

* * * * *